US010665938B2

(12) United States Patent
Ebberg et al.

(10) Patent No.: US 10,665,938 B2
(45) Date of Patent: May 26, 2020

(54) ANTENNA DEVICE

(71) Applicant: Fraunhofer-Gesellschaft zur Foerderung der angewandten Forschung e.V., Munich (DE)

(72) Inventors: Alfred Ebberg, Heide (DE); Ulrich Hofmann, Itzehoe (DE); Winfried Schernus, Heide (DE); Frank Senger, Hardenfeld (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 271 days.

(21) Appl. No.: 15/727,858

(22) Filed: Oct. 9, 2017

(65) Prior Publication Data

US 2018/0102590 A1 Apr. 12, 2018

(30) Foreign Application Priority Data

Oct. 11, 2016 (DE) ..... 10 2016 219 737

(51) Int. Cl.

| | |
|---|---|
| ***H01Q 3/08*** | (2006.01) |
| ***H01Q 1/32*** | (2006.01) |
| ***H01Q 1/38*** | (2006.01) |
| ***H01Q 15/14*** | (2006.01) |
| ***H01Q 21/06*** | (2006.01) |
| ***H01Q 15/02*** | (2006.01) |
| ***H01Q 1/36*** | (2006.01) |
| ***H01Q 3/16*** | (2006.01) |

(52) U.S. Cl.

CPC ..... *H01Q 3/08* (2013.01); *H01Q 1/3233* (2013.01); *H01Q 1/36* (2013.01); *H01Q 1/38* (2013.01); *H01Q 3/16* (2013.01); *H01Q 15/02* (2013.01); *H01Q 15/14* (2013.01); *H01Q 21/061* (2013.01)

(58) Field of Classification Search

CPC ..... H01Q 3/08; H01Q 1/36; H01Q 3/16

See application file for complete search history.

(56) References Cited

U.S. PATENT DOCUMENTS

2003/0034916 A1 2/2003 Kwon et al.
2003/0160722 A1* 8/2003 Kwon ..... H01Q 3/08 343/700 MS

FOREIGN PATENT DOCUMENTS

CN 205543213 U 8/2016

OTHER PUBLICATIONS

Baek, Chang-Wook et al., "2-D Mechanical Beam Steering Antenna Fabricated Using MEMS Technology", IEEE MTT-S International Microwave Symposium Digest, May 2001, pp. 211-214.

(Continued)

*Primary Examiner* — Graham P Smith

(74) *Attorney, Agent, or Firm* — Michael A. Glenn; Perkins Coie LLP

(57) ABSTRACT

The invention relates to an antenna device having at least one antenna element. The antenna element is implemented so as to emit electromagnetic radiation in a beam direction advantageously at frequencies in the GHz range and/or receive same from a beam direction. In addition, the antenna element is arranged on a carrier element which is arranged relative to a holding element. In addition, the carrier element is movable relative to the holding element.

25 Claims, 8 Drawing Sheets

(56) References Cited

OTHER PUBLICATIONS

Baek, Chang-Wook et al., "A V-Band Micromachined 2-D Beam-Steering Antenna Driven by Magnetic Force With Polymer-Based Hinges", IEEE Transactions on Microwave Theory and Techniques; vol. 51; No. 1, Jan. 2003, pp. 325-331.
Chiao, Jung-Chin et al., "MEMS Reconfigurable Vee Antenna", IEEE MTT-S International Microwave Symposium Digest, 1999, pp. 1515-1518.
Fan, Li et al., "Two-Dimensional Optical Scanner with Large Angular Rotation Realized by Self-Assembled Micro-Elevator", Broadband Optical Networks and Technologies: An Emerging Reality/Optical MEMS/Smart Pixels/Organic Optics and Optoelectronics. 1998 IEEE/LEOS Summer Topical Meetings, Jul. 1998, pp. 107-108.
Kyrö, Mikko et al., "5×1 Linear Antenna Array for 60 GHz Beam Steering Applications", Proceedings of the 5th European Conference in Antennas and Propagation (EUCAP); Apr. 11-15, 2011, Apr. 11, 2011, pp. 1258-1262.
Nataraja, Arun et al., "A 77-GHz Phase-Array Transceiver With On-Chip Antennas in Silicon: Transmitter and Local LO-Path Phase Shifting", IEEE Journal of Solid-State Circuits; vol. 41; No. 12, Dec. 2006, pp. 2807-2819.
Zhan, Y.P. et al., "On-Chip Antennas for 60-GHz Radios in Silicon Technology", IEEE Transactions on Electron Devices; vol. 52; No. 7:, Jul. 2005, pp. 1664-1668.
Petersen, "Silicon torsional scanning mirror", IBM Journal of Research and Development; vol. 24; Issue 5, Sep. 1980, pp. 631-637.
Senger, et al., "Centimeter scale MEMS scanning mirrors for high power laser application", Proceedings of SPIE vol. 9375, Feb. 2015, 16 pages.
Chauvel, Dominique, "A micro-machined microwave antenna integrated with its electrostatic spatial scanning", Proceedings IEEE The Tenth Annual International Workshop on Micro Electro Mechanical Systems. An Investigation of Micro Structures, Sensors, Actuators, Machines and Robots, Aug. 6, 2002, Aug. 6, 2002.

* cited by examiner

ANTENNA DEVICE

CROSS-REFERENCE TO RELATED APPLICATION

This application claims priority from German Application No. 10 2016 219 737.1, which was filed on Oct. 11, 2016, which is incorporated herein in its entirety by this reference thereto.

BACKGROUND OF THE INVENTION

The invention relates to an antenna device. The antenna device particularly serves for transmitting and/or receiving electromagnetic signals.

At present, radar-based driver assistance systems, radar-based sensors like filling level or distance and velocity measuring means, but also communication systems for high-bit-rate wireless data transmission, systems of security technology, building surveillance and indoor navigation advantageously operate in the high GHz frequency range. All the applications mentioned use antennas having a certain directional effect or directivity which usually additionally has to be variable in space. With radar systems as are, for example, used in "adaptive cruise control" systems in automobile industry, the directivity serves for spatially detecting the target. With high-bit-rate communication systems, reusing the frequency spectrum is made possible by directive emission. In addition, transmission losses between transmitter and receiver are compensated partly by means of using antennas of directive emission, and spurious reflections can be masked out.

Spatially steering or turning the beam direction of an antenna can be performed mechanically using actuators as is, for example, the case with parabolic antennas for radio astronomy. This way of adjustment is very precise, but the times for obtaining a certain position are in the range of minutes. Very fast steering in the range of microseconds, in contrast, is made possible by so-called phased array antenna systems which consist of a plurality of individual antennas (frequently of a planar setup) and which each comprise an electronically adjustable phase shifter. For achieving directivity, phased array antennas use at least two individual emitters. Additionally, a complicated drive network is used.

Frequently, combinations of slower, mechanic and faster, electronic beam steering are used.

Microwave antennas are frequently realized as separate components on substrates suitable for microwaves like, for example, aluminum oxide ceramics, $Al_2O_3$, and connected to the active component (transmitter, receiver) via a conducting connection. Wafer-level integration of on-chip antennas on silicon has been examined intensely for many years. The desire for miniaturization and cost reduction plays an important role here. In [1], inverted-F and Yagi antennas on a silicon substrate are described and first measuring results presented. The steerability of the directional pattern, however, is not examined here.

A 77 GHz transceiver integrated on silicon-germanium SiGe having a phased array arrangement consisting of four emitter elements for beam steering is described in [2]. Thus, every emitter element is driven by means of a circuit including two mixers, a phase shifter and a power combiner. Increasing the microwave power emitted entails one power amplifier each for every antenna element. The integrated antenna elements are simple dipole antennas. However, the overall circuit complexity is immense.

An antenna arrangement for a frequency of 60 GHz including five monopole antennas which are driven by digital phase shifters switched by means of MEMS switches is described in [3]. The phase shifters are switchable in steps of 20 degrees and thus only allow discrete beam steering.

A first suggestion for a mechanically steerable antenna pattern using MEMS can be found in [4]. It deals with a half-wave dipole, the arms of which can be moved independently of each other using MEMS linear actuators.

[5] describes an arrangement suggesting electronic and MEMS-based mechanical steering of the directional pattern of the antenna. Here, every antenna element of an array arrangement is implemented to be steerable individually. Additionally, varying the drive phase is suggested. This arrangement is based on an optical 2D scanner having mirror areas of 400 μm×400 μm [6]. Patch antennas for a frequency of 76.5 GHz, however, entail an area of at least 800 μm×600 μm. Additionally, it is not described how the individual antenna elements are to be driven.

A mechanically steerable 2×2 patch array for a frequency of 60 GHz is described in [7, 8, 9]. The structure is formed on a glass substrate, a dielectric polymer material benzocyclo-butene (BCB) is used for suspension and a substrate material for the antennas; the structure is stabilized by means of a silicon frame. Steering takes place using magnetic forces around two axes by an angle of +−20 degrees. However, the structure is complex and an additional integration of active components seems to be doubtful.

It is the object of the invention to present an antenna device which allows miniaturization without having to deal with significant losses in the radiation characteristics.

SUMMARY

An embodiment may have an antenna device, wherein the antenna device has at least one antenna element, wherein the antenna element is implemented so as to emit electromagnetic radiation in a beam direction—advantageously at frequencies in the GHz range—and/or receive same from a beam direction, wherein the antenna element is arranged on a carrier element, wherein the carrier element is arranged relative to a holding element—and advantageously in a recess thereof, and wherein the carrier element is moveable relative to the holding element.

The antenna device comprises at least one antenna element. The antenna element is implemented so as to emit electromagnetic radiation in a beam direction advantageously at frequencies in the GHz range, and/or receive same from a beam direction. The antenna device comprises a carrier element. Thus, the antenna element and the carrier element are implemented and tuned to each other such that the carrier element is moveable relative to the holding or retaining element.

The inventive antenna device comprises at least one antenna element and a carrier element. The antenna element emits electromagnetic radiation in the direction of a beam direction advantageously in the GHz range and/or receives such radiation from the beam direction. Receiving and transmitting thus take place mainly in the beam direction where, in one implementation, a main lobe of the antenna element is located. This implementation deals with a millimeter wave antenna device. The at least one antenna element (in one implementation, there are several antenna elements) is arranged on the carrier element. The carrier element in turn is arranged relative to a holding element. In one implementation, the carrier element is arranged, in particular, in a recess of the holding element. The mechanically generated movement of the beam direction is realized by moving the carrier element relative to the holding element. The carrier element and the holding element are mechanical components of the antenna device. The antenna device is characterized by the fact that its directional characteristic can be steered in space mechanically, thereby allowing a quick change in the beam direction and, in particular, continuous changes. In one implementation, the directional characteristic is, above all, determined by the orientation of an antenna lobe. In one implementation, mechanical steering of the beam direction is realized using an actuator. In one implementation, the at least one antenna element and the carrier element are integrated directly on the actuator.

The antenna device represents a millimeter wave antenna steerable relative to the beam direction which, depending on its implementation, exhibits at least some of the following advantages:

- Since standard processes from semiconductor industry can be used for manufacturing, cost advantages result.
- Continuous steering is possible by the mechanical implementation.
- In addition, very fast steering of the beam direction, for example in the millisecond range, can be achieved.
- Steering takes place in dependence on the mechanical implementation of the components so that, in contrast to phased array systems, for example, no further active, in particular electronic, elements are used.

In one implementation, the antenna element is contacted or connected fixedly to the carrier element so that the carrier element is moved relative to the holding element, the movement of the antenna element relative to the holding element resulting from this.

In one implementation, the dimensions of the antenna element (that is dimensioning thereof) are between one tenth of and a thousand times a wavelength of electromagnetic radiation emitted and/or received. When the wavelength is referred to by $\lambda$, the dimensions in this implementation are between $\lambda/10$ and $1000*\lambda$.

In one implementation, the antenna device has been produced at least partly using methods of microsystems technology.

In accordance with an implementation, the carrier element consists at least partly of a dielectric and low-loss material.

In one implementation, steering the beam direction is done electrostatically using a correspondingly implemented actuator.

One implementation deals with an MEMS actuator.

In one implementation, the actuator causes movement in that plane where the carrier element is located in a rest position and/or where the antenna element is arranged. In an alternative implementation, movement takes place perpendicularly to said plane.

In one implementation, the carrier element is suspended relative to a holding element. Suspension here allows different movements. Thus, depending on the implementation, single-axis or multi-axes suspensions may be realized. The suspensions allow line-shaped (quasi-static or resonant), raster-shaped (one axis quasi-static, one axis resonant), Lissajous-shaped (both axes resonant) or completely vectorial (both axes quasi-static) movements. These movements each entail different orientations of the beam direction or lobe of the antenna element.

Communication applications exemplarily use quasi-static vectorial tracking of the beam direction. With automobile radar systems, resonant scanning of the largest possible solid-angle region may be entailed.

In one implementation, the carrier element is implemented as an MEMS micromirror scanner. Such scanners are, for example, made from silicon and are described in [10], for example. For this implementation, the mirror surface is replaced by a metal structure which acts as an antenna. Thus, at least one structure for an antenna element is applied here. The conventional fields of applications of such micromirror scanners are micromechanical laser beam deflecting systems, compare [11], for example.

In one implementation, the carrier element is arranged in a recess of a holding element. The carrier element thus is located at least partly in a holding element or is included in a holding element. The recess of the holding element is, in one implementation, limited by a round and, in an alternative implementation, is a continuous recess.

In one implementation, the carrier element is connected indirectly to a holding element via at least one fixing element. In one implementation, the fixing element is a spring via which the carrier element is supported in the holding element to be steerable around an axis. Thus, the spring fixing element generates a restoring force.

In one implementation, the fixing element is implemented such that the fixing element is mechanically resilient. Thus, the fixing element is deformable elastically, the result being a spring force caused by deforming or by moving the carrier element, whose effect is contrary to the direction of deformation and, thus, back to a starting state.

In one implementation, the fixing element is implemented to be a torsion spring.

In accordance with an implementation, the fixing element consists at least partly of silicon or polysilicon.

In one implementation, the carrier element is arranged in the holding element to be at least rotatable around a rotational axis. In one implementation, the carrier element is arranged to be rotatable within the holding element.

In one implementation, the rotational axis is perpendicular to the carrier element. In this implementation, the carrier element is rotated within that plane where the carrier element is located. When, in one implementation, the carrier element is a disc, the disc is rotated within that plane where its greatest extension is located.

In an alternative or additional implementation, the rotational axis is located within a plane where the carrier element is located in an orientation. The carrier element, in this implementation, is tilted around a rotational axis. In one implementation, the rotational axis passes through the carrier element or through a plane in parallel to that plane where the carrier element advantageously has its greatest extension.

In accordance with an embodiment, rotations of the carrier element around the rotational axis generate an angle between +90° and −90° relative to a rest position.

In another implementation, rotational angles between +20° and −20° relative to a rest position are generated.

In accordance with an implementation, the carrier element is movable in a translatory manner. The carrier element is thus shifted. In one implementation, this is done relative to the holding element.

In one implementation, the antenna device comprises vacuum encapsulation. Such a hermetic encapsulation results in attenuation by gas molecules to be reduced to a minimum. In resonance operation, this results in a considerable gain in amplitude. This is of advantage since large vibrational amplitudes allow detecting the largest possible solid angle.

Alternatively or additionally, in one implementation, it is provided for the antenna device to be encapsulated hermetically.

In one implementation, the antenna device comprises at least one actuator which is implemented correspondingly so as to move the carrier element together with the antenna element relative to the holding element.

Thus, in one implementation, the actuator is implemented so as to move the carrier element based on electrostatic and/or electromagnetic and/or piezoelectric and/or thermal principles. This consequently refers to the different variations for generating a force which causes movement of the carrier element.

In one implementation, the antenna element is implemented to be a Vivaldi antenna. Such an antenna exhibits a high bandwidth.

Alternatively, the antenna element is implemented as an antenna patch or a dipole or a slot antenna or Yagi antenna. In one implementation, at least one squared, rectangular or round patch is present. In another implementation, the antenna element consists of an array made of several patches. This causes a higher directional effect.

In one implementation, the antenna device comprises several antenna elements. In one implementation, the antenna elements are arranged only on the carrier element.

In accordance with an implementation, the antenna device comprises several antenna elements. Thus, the antenna elements are arranged on different carrier elements which are each arranged in a holding element.

In one implementation, the several antenna elements are arranged regularly and, advantageously, in a matrix structure.

In one implementation, the mechanical orientation of the beam direction is supplemented by an electronic variation. Thus, it is provided for the antenna device to comprise drive means. The drive means is implemented so as to drive the several antenna elements electrically such that the beam direction depends on driving.

In one implementation, the antenna device comprises a conducting structure for electrically contacting the antenna element. When there are several antenna elements, in one implementation, there are several conducting structures and, in an alternative implementation, the conducting structure serves for contacting several antenna elements. Thus, the conducting structure—or, maybe, the conducting structures—are arranged at least partly on the carrier element.

One implementation is for the conducting structure to be implemented as a coplanar line.

In one implementation, the antenna device comprises at least one beam-shaping structure. The beam-shaping structure thus acts on the radiation emanating from the antenna element (or from the antenna elements), and/or the beam-shaping structure determines the shape of the radiation received by the antenna element (or antenna elements).

The following implementations relate to individual variations of the beam-shaping structure, wherein combinations of said variations are present in further implementations.

In accordance with one implementation, the beam-shaping structure is implemented as a lens. In one implementation, the beam-shaping structure and the antenna element here are arranged to each other such that the antenna element is located in the focus of the beam-shaping structure implemented as a lens. In one implementation, this is a spherical lens or a cylindrical lens.

In another implementation, the beam-shaping structure is implemented as a reflector.

In a further implementation, the beam-shaping structure is implemented as a parabolic mirror.

In accordance with another implementation, the beam-shaping structure consists of an adjusting structure, a conical portion and a semi-cylinder.

In one implementation which relates to the structure of the antenna device, a glass layer is arranged between the carrier element and the antenna element. In another implementation, the carrier element consists of silicon. In one implementation, the antenna element is applied on a glass-silicon substrate as a carrier element. Such a substrate increases the efficiency of the antenna element. Silicon, due to its residual conductivity—compared to other substrate materials—exhibits relatively high losses for electromagnetic waves. The losses can be reduced when a thin layer of a low-loss glass is applied onto the silicon substrate. The electromagnetic waves then propagate only partly in the lossy silicon. This causes the increase in efficiency of the antenna.

In particular, there are numerous ways of implementing and further developing the inventive antenna device.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
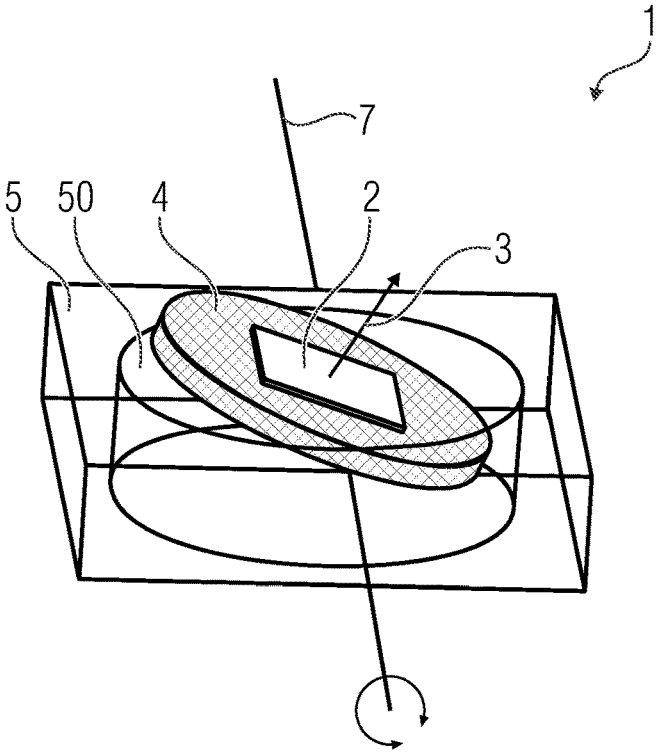
FIG. 1 is a spatial and partly transparent illustration of a first variation of the antenna device.

FIG. 1 shows a silicon block as a holding element 5. The carrier element 4 which is exemplarily implemented in the type of a micro mirror, is suspended in the recess 50 to be rotatable around the rotational axis 7. A rectangular patch is provided here as the antenna element 2. Producing such a patch exemplarily takes place by sputtering or evaporating a thin metal layer. The metal may, for example, be gold or aluminum. Alternative patches comprise a squared or round outline. Feeding signals and draining signals exemplarily takes place in connection with the mechanical suspension via coplanar grounded coplanar or micro strip lines—which are not illustrated here. The beam direction 3 is perpendicular to the carrier element 4 so that rotating the carrier element 4 also rotates the beam direction 3. A radiation lobe—which is not illustrated here—is located in the beam direction 3 as a main beam direction.

Advantageously, the carrier element 4 and the at least one antenna element 2 arranged thereon comprise the smallest possible mass so that an actuator is able to achieve the highest possible speeds for moving the antenna element 2. The MEMS arrangement of the antenna device 1 thus exemplarily allows applications in an imaging millimeter wave radar device.

Figure 2:
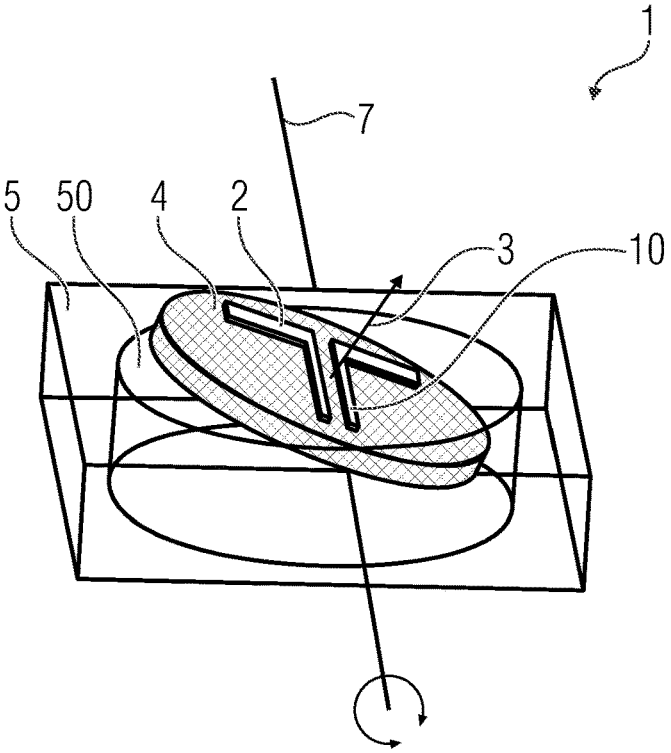
FIG. 2 is a spatial and partly transparent illustration of a second variation of the antenna device.

FIG. 2 shows a similar implementation of the antenna device 1 when compared to FIG. 1. However, the antenna element 2 is a dipole which is fed via a conducting structure 10.

Figure 3:
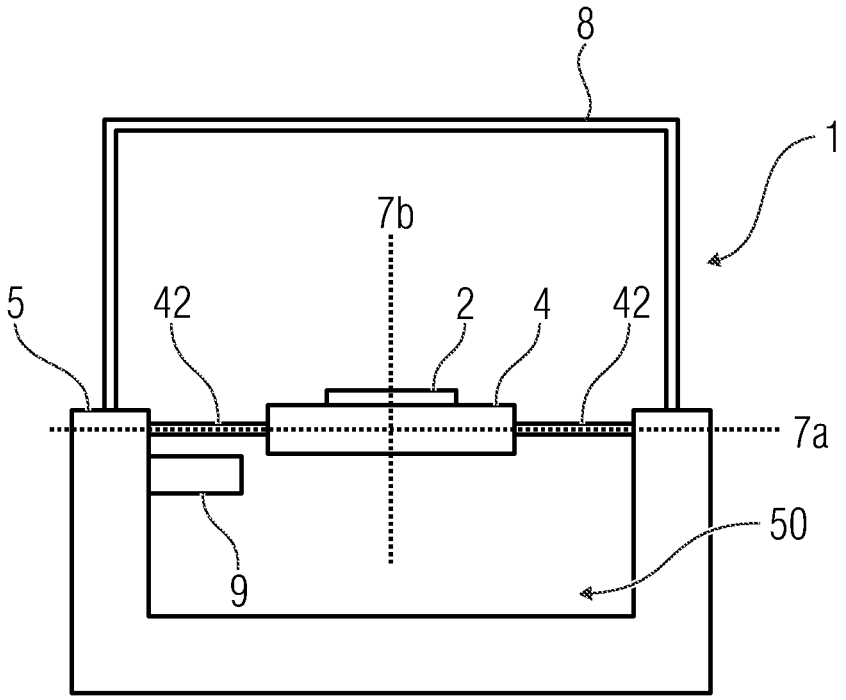
FIG. 3 shows a sectional view of a variation of the antenna device.

FIG. 3 shows a sectional view of an antenna device 1 having an antenna element 2 on the carrier element 4. The carrier element 4 is connected, via two fixing elements 42, to the holding element 5 within the recess 50 of which it is located. The fixing elements 42 here are implemented such that they are of an elastic spring type. In one implementation, the fixing elements 42 are implemented as torsion springs so that, after deflection, the result is a spring force which has an effect back to a starting or rest position. In addition, there is an actuator 9 which moves the carrier element 4, in this case around two rotational axes 7*a*, 7*b*. One rotational axis 7*a* is located within that plane where the carrier element 4 is located in a rest position, that is here in case the carrier element 4 implemented as a disc is in parallel to the ground of the holding element 5. A kind of tilting takes place around this rotational axis 7*a*. The other rotational axis 7*b* is perpendicular to the carrier element 4 so that, when rotating, the carrier element 4 rests in a rest plane. A vacuum encapsulation 8 is also indicated here.

Figure 4:
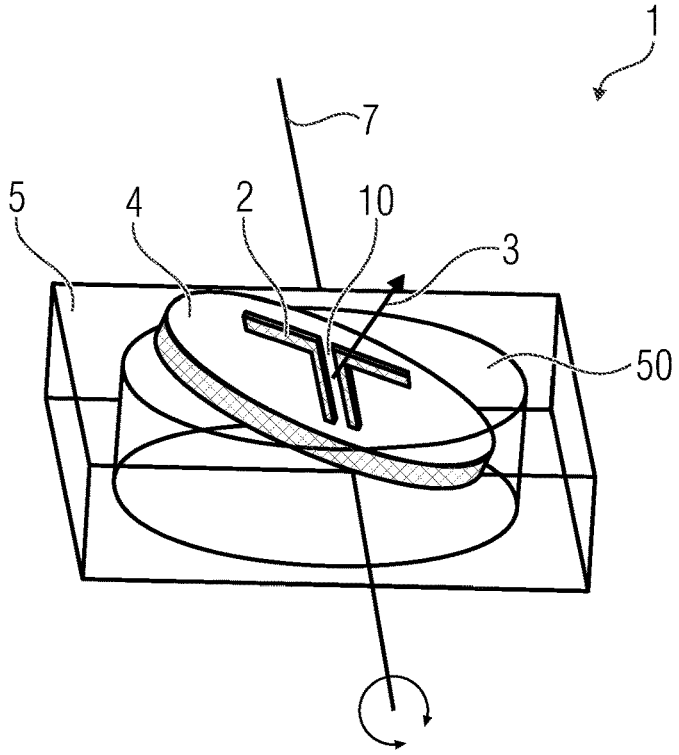
FIG. 4 is a spatial and partly transparent illustration of a third variation of the antenna device.

In the implementation of the antenna device 1 illustrated in FIG. 4, the antenna element 2 is a slot antenna and the conducting structure 10 is implemented as a coplanar line.

Increasing the antenna gain may, for example, be achieved by using an array radiator as the antenna element 2, wherein the antenna element 2 exemplarily consists of squared, rectangular or round individual patch antennas.

Figure 5:
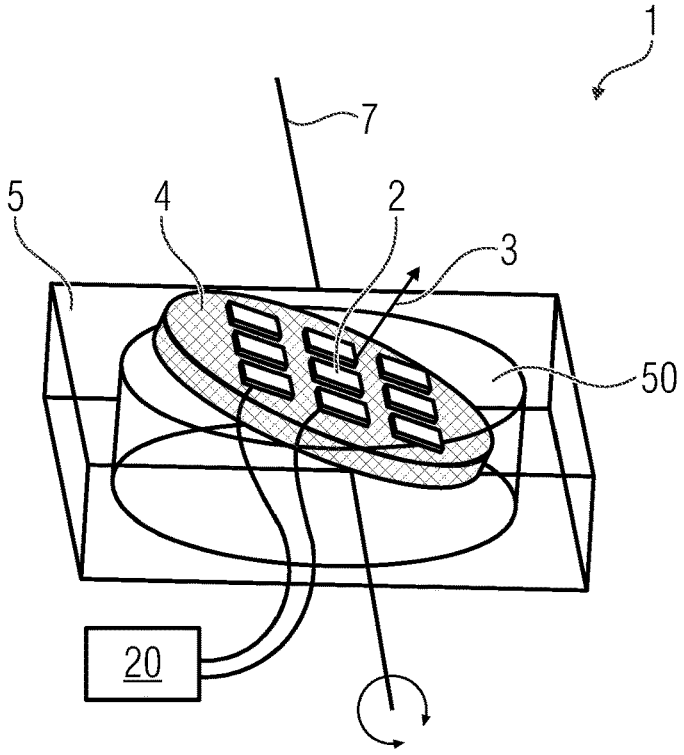
FIG. 5 is a spatial and partly transparent illustration of a fourth variation of the antenna device.
Figure 8:
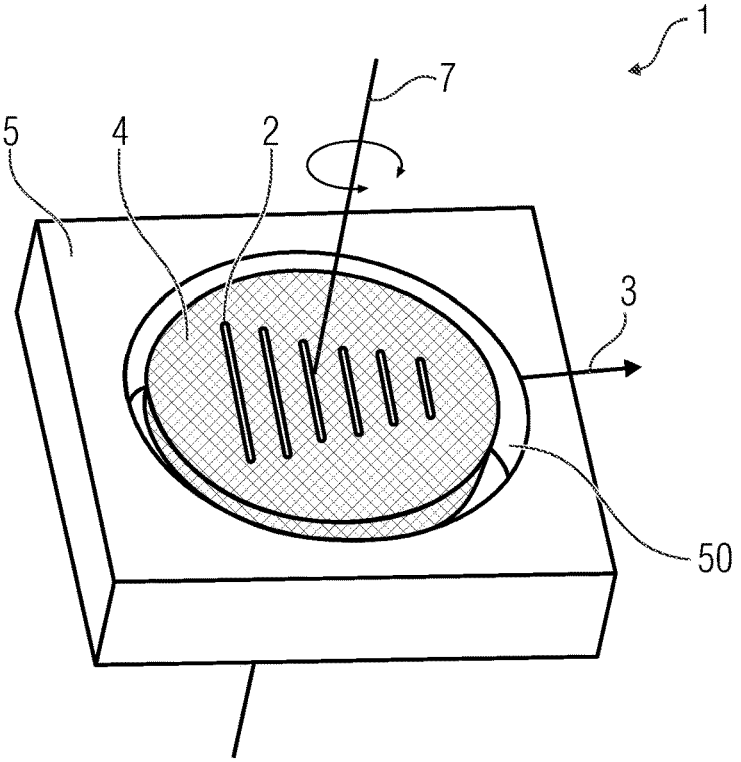
FIG. 8 is a spatial and partly transparent illustration of a seventh variation of the antenna device.

FIG. 5 shows such an antenna device 1 having rectangular individual patch antenna emitters belonging to the antenna element 2. Alternatively, the arrangement of FIG. 8 may, for example, be arranged several times in the style of an array. What is also to be seen is the driving element 20 which, for reasons of clarity, is connected to only two antenna elements 2 and which drives the antenna elements 2 electrically such that, in addition to the mechanical steering of the beam direction 3, electronic steering is also caused.

A further increase in the antenna gain results from using a suitably dimensioned beam-shaping structure 11.

Figure 6:
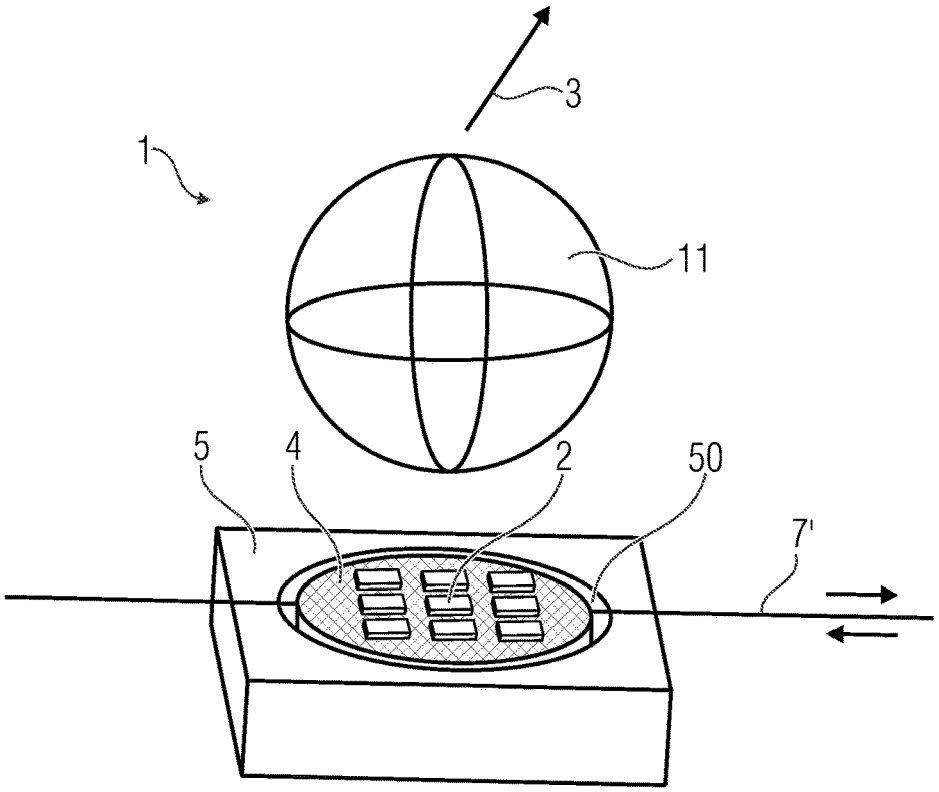
FIG. 6 is a spatial and partly transparent illustration of a fifth variation of the antenna device.

This is shown in FIG. 6. The beam-shaping structure 11 here is implemented as a dielectric lens and, in this example, particularly as a spherical lens. Steering the radiation lobe or beam direction 3 in the implementation shown is done by laterally shifting the carrier element 4 and, in this example, also the holding element 5 along an axis of movement 7'. Instead of a spherical lens 11, alternatives—not illustrated here—provide for parabolic, hyperbolic, ellipse-shaped or cosine-shaped bodies made of a suitable dielectric material as the lens.

Figure 7:
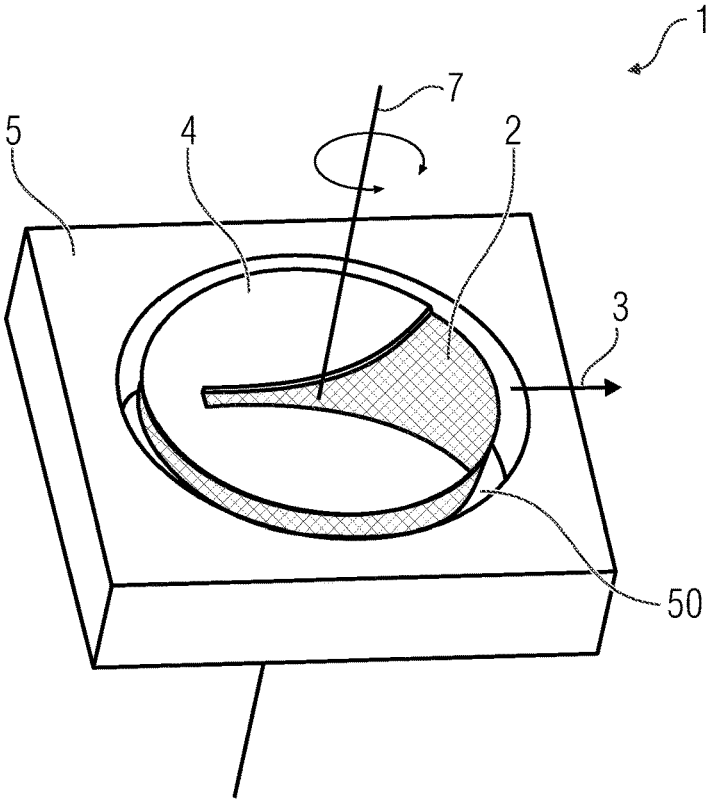
FIG. 7 is a spatial and partly transparent illustration of a sixth variation of the antenna device.

FIG. 7 shows an antenna device 1 in which the rotational axis 7 is perpendicular to the carrier element 4 and, consequently, steering of the antenna lobe or beam direction 3 is around the rotational axis 7. The lobe here remains in the same plane. The antenna element 2 here is a Vivaldi antenna. In a similar implementation in FIG. 8, the antenna element 2 is a Yagi arrangement.

Figure 9:
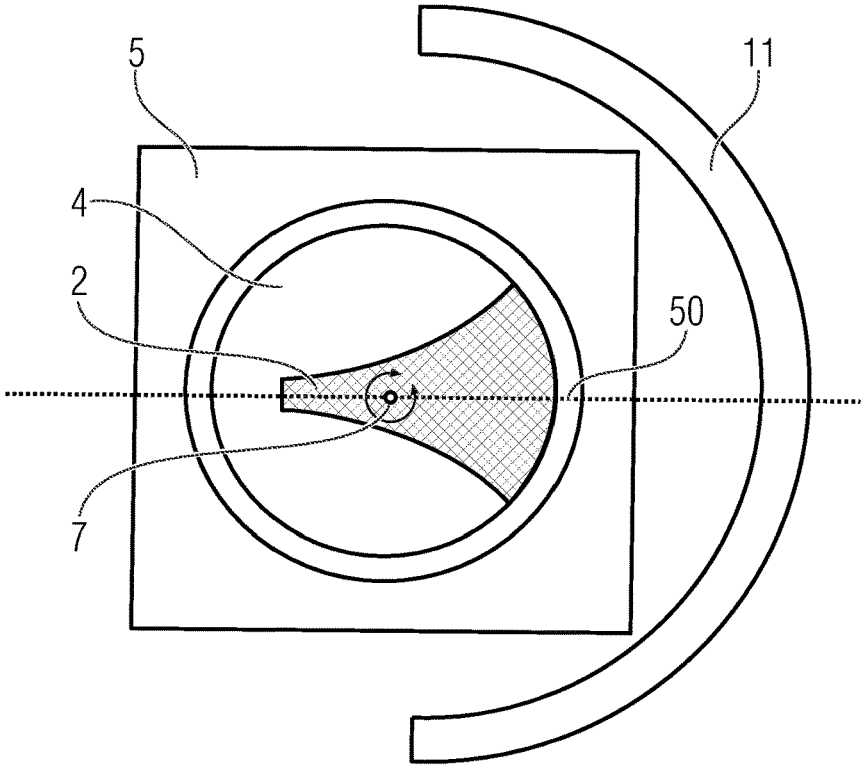
FIG. 9 shows a top view of an eighth variation of the antenna device.
Figure 10:
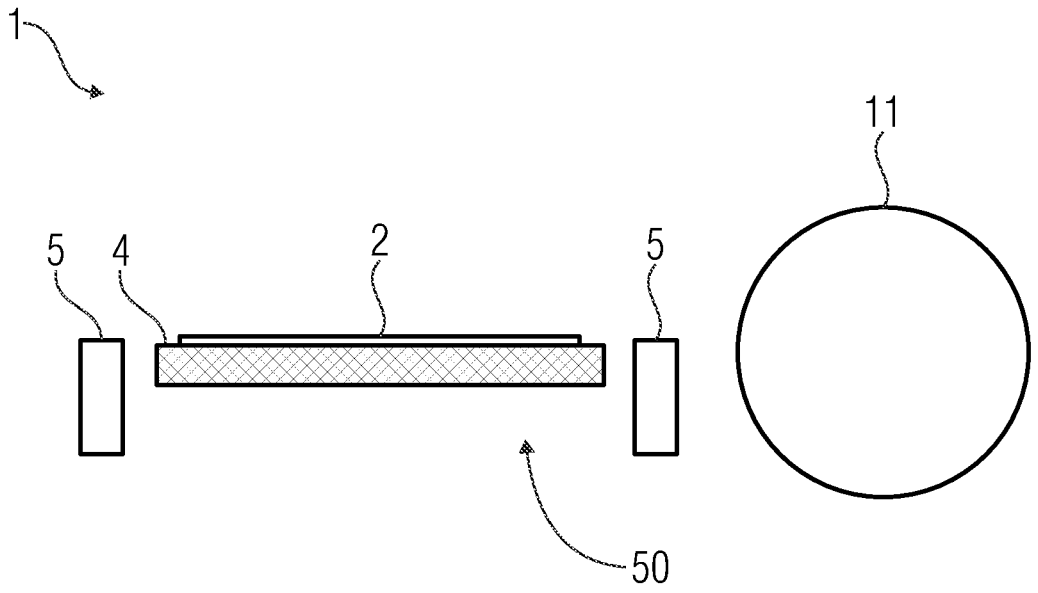
FIG. 10 shows a sectional view of the implementation of FIG. 9.

FIG. 9 shows a top view of an antenna device 1 having a Vivaldi antenna as an antenna element 2. A beam-shaping structure 11 which extends in a semi-circle around the holding element 5 or around the carrier element 4, which is circular here, is used for increasing the antenna gain. The beam-shaping structure 11 here is a cylindrical lens—as the sectional view of FIG. 10 shows.

Figure 11:
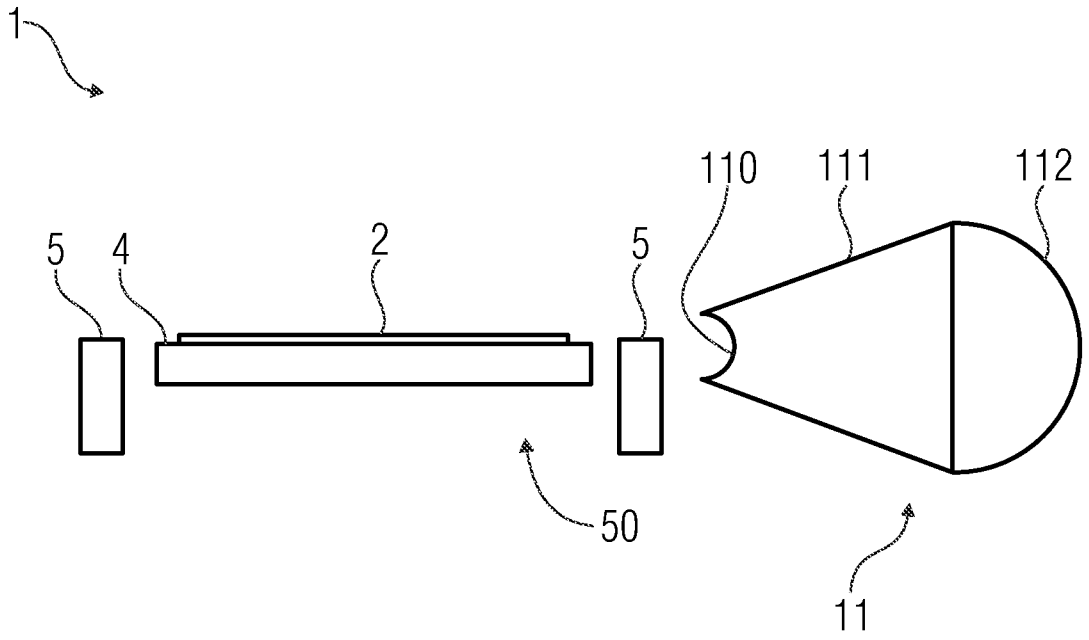
FIG. 11 shows a sectional view of a ninth variation of the antenna device.

The beam-shaping structure 11 of the implementation of FIG. 11 comprises a semi-cylinder 112 which leads to an adjusting structure 110 via a conical structure 111. Thus, the electromagnetic waves of the antenna element 2 are adjusted to the semi-cylinder 112.

Instead of a semi-cylinder, in an alternative variation—not illustrated here—the beam-shaping structure comprises a parabolic, hyperbolic, ellipse-shaped or cosine-shaped body.

Figure 12:
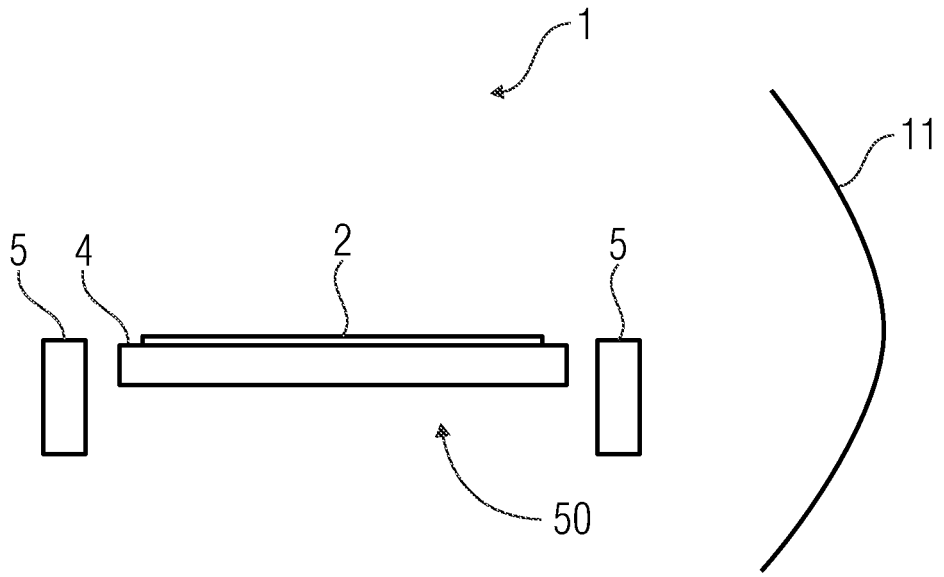
FIG. 12 shows a sectional view of a tenth variation of the antenna device.
Figure 13:
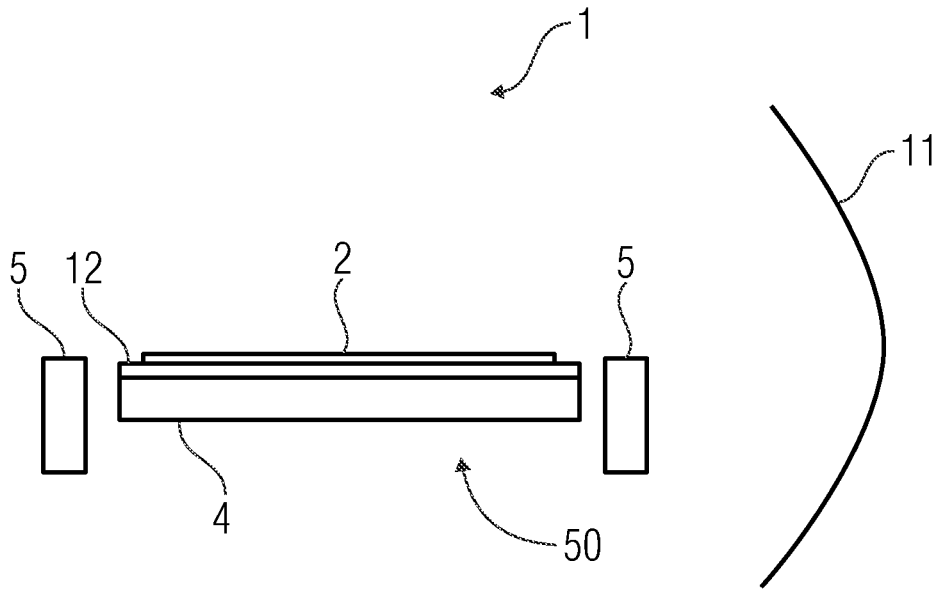
FIG. 13 shows a sectional view of an eleventh variation of the antenna device.

In the implementations of FIG. 12 and FIG. 13, the beam-shaping structure 11 is a parabolic mirror.

The implementations of FIGS. 10 to 12 each show the carrier element 4 onto which the at least one antenna element 2 is located. Furthermore, the carrier element 4 is arranged in a recess 50—which is continuous here—of a holding element 5.

In the implementation of FIG. 13, a glass layer 12 is arranged between the carrier element 4 which exemplarily is made of silicon, and the antenna element 2. The glass layer 12 here increases the antenna's efficiency by reducing losses.

Figure 14:
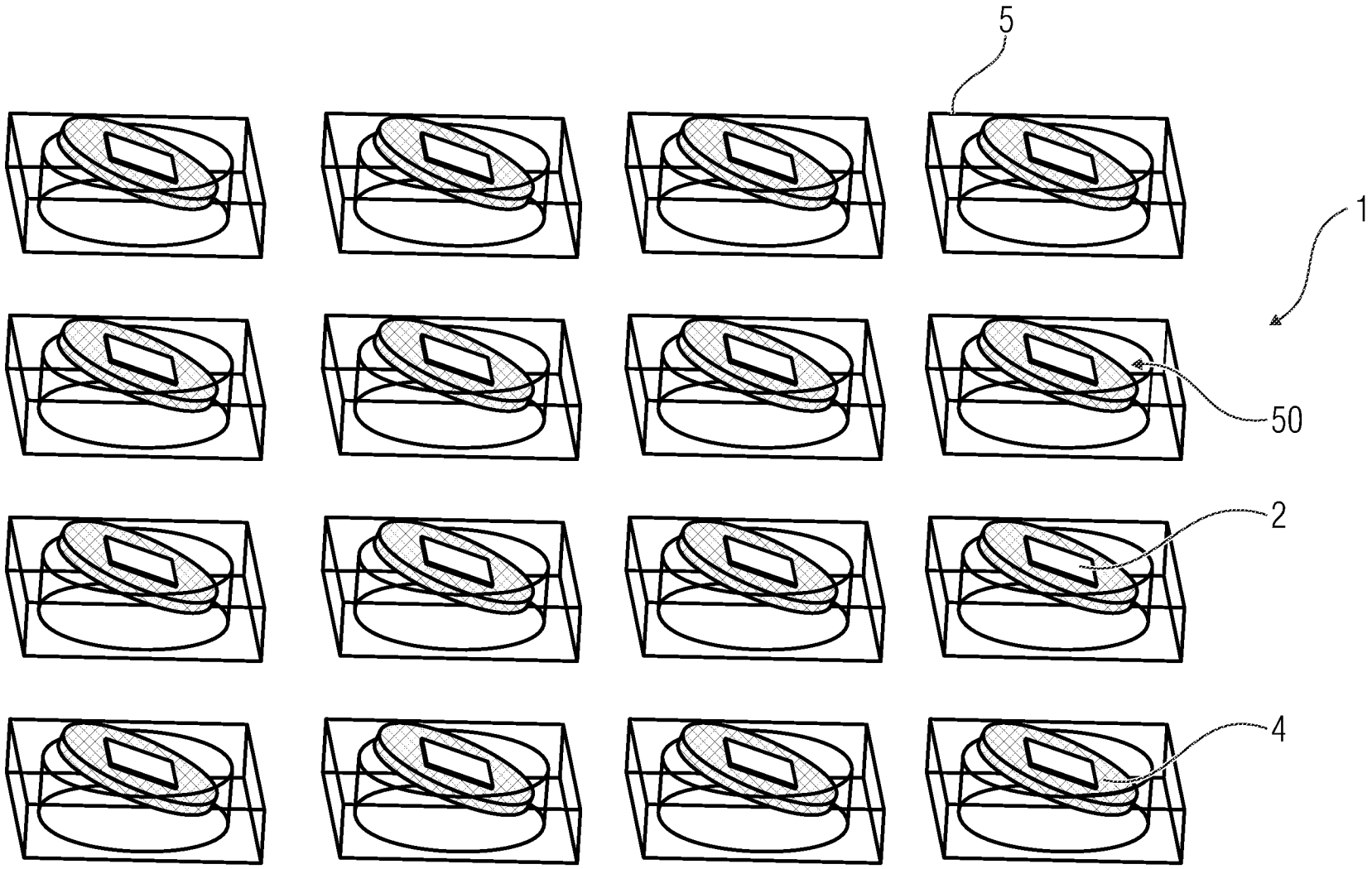
FIG. 14 is a spatial and partly transparent illustration of a twelfth variation of the antenna device having several holding elements.

FIG. 14 shows an arrangement where the antenna device 1 comprises several antenna elements 2 which are each arranged on a carrier element 4. The carrier elements 4 in turn are each located in a recess 50 of a holding element 5. The carrier elements 4 here may be rotated individually and, in particular, tilted individually.

While this invention has been described in terms of several embodiments, there are alterations, permutations, and equivalents which will be apparent to others skilled in the art and which fall within the scope of this invention. It should also be noted that there are many alternative ways of implementing the methods and compositions of the present invention. It is therefore intended that the following appended claims be interpreted as including all such alterations, permutations, and equivalents as fall within the true spirit and scope of the present invention.

REFERENCES

[1] Y. P. Zhan et al. "On-Chip Antennas for 60-GHz Radios in Silicon technology", IEEE Transactions on Electron Devices, Vol. 52, No. 7, July 2005.

[2] A. Nataraja et al. "A 77-GHz Phase-Array Transceiver With On-Chip Antennas in Silicon: Transmitter and Local LO-Path Phase Shifting", IEEE Journal of Solid-State Circuits, Vol. 41, Nor. 12, December 2006.

[3] M. Kyrö et al. "5×1 Linear Antenna Array for 60 GHz Beam Steering Applications", Proceedings of the 5th European Conference on Antennas and Propagation (EUCAP), Rome, 2012.

[4] J.-C. Chiao et al. "MEMS Reconfigurable Vee Antenna", IEEE MTT-S International Microwave Symposium Digest, Anaheim, Calif., pp. 1515-1518, 1999.

[5] US 2003/0034916 A1.

[6] L. Fan, M. C. Wu, "Two-Dimensional Optical Scanner with Large Angular Rotation Realized by Self-Assembled Micro-Elevator"

[7] C.-W. Baek et al. "2-D Mechanical Beam Steering Antenna Fabricated Using MEMS Technology", IEEE MTT-S International Microwave Symposium Digest, San Francisco, Calif., pp. 211-214, 2001

[8] C.-W. Baek et al. "A V-band micromachined 2-D beam-steering antenna driven by magnetic force with polymer-based hinges", IEEE Transactions on Microwave Theory and Techniques, vol. 51, no. 1, pp. 325-331, January 2003

[9] US 2003/0160722 A1.

[10] Senger, Frank; Hofmann, Ulrich G.; Wantoch, T. von; Mallas, Christian; Janes, Joachim; Benecke, Wolfgang; Herwig, Patrick; Gawlitza, Peter; Ortega Delgado, Moises Alberto; Gruhne, Christoph; Hannweber, Jan; Wetzig, Andreas, "Centimeter scale MEMS scanning mirrors for high power laser application", Proceedings of SPIE 9375, 2015

[11] K. E. Petersen, "Silicon torsional scanning mirror", IBM Journal of Research and Development, Volume 24 Issue 5, pp. 631-637, September 1980

The invention claimed is:

1. An antenna device, wherein the antenna device comprises at least one antenna element, wherein the antenna element is implemented so as to emit electromagnetic radiation in a beam direction—advantageously at frequencies in the GHz range—and/or receive same from a beam direction, wherein the antenna element is arranged on a carrier element, wherein the carrier element is arranged relative to a holding element—and advantageously in a recess thereof, wherein the carrier element is moveable relative to the holding element, and wherein a glass layer is arranged between the carrier element and the antenna element.

2. The antenna device in accordance with claim 1, wherein the antenna element is contacted fixedly to the carrier element.

3. The antenna device in accordance with claim 1, wherein dimensions of the antenna element are between one tenth of and one thousand times a wavelength of electromagnetic radiation emitted and/or received.

4. The antenna device in accordance with claim 1, wherein the antenna device has been produced at least partly using methods of microsystems technology.

5. The antenna device in accordance with claim 1, wherein the carrier element comprises, at least partly, a dielectric and low-loss material.

6. The antenna device in accordance with claim 1, wherein the carrier element is connected to the holding element via at least one fixing element, and wherein the fixing element is implemented to be mechanically resilient.

7. The antenna device in accordance with claim 6, wherein the fixing element comprises, at least partly, silicon or polysilicon.

8. The antenna device in accordance with claim 1, wherein the carrier element is arranged in the holding element to be at least rotatable around a rotational axis.

9. The antenna device in accordance with claim 8, wherein the rotational axis is perpendicular to the carrier element.

10. The antenna device in accordance with claim 8, wherein the rotational axis is located within a plane where the carrier element is located in an orientation.

11. The antenna device in accordance with claim 8, wherein rotations of the carrier element generate an angle between +90° and −90° relative to a rest position.

12. The antenna device in accordance with claim 8, wherein rotations of the carrier element generate an angle between +20° and −20° relative to a rest position.

13. The antenna device in accordance with claim 1, wherein the carrier element is moveable in a translatory manner.

14. The antenna device in accordance with claim 1, wherein the antenna device comprises a vacuum encapsulation and/or wherein the antenna device is encapsulated hermetically.

15. The antenna device in accordance with claim 1, wherein the antenna device comprises at least one actuator which moves the carrier element relative to a holding element, and wherein the actuator is implemented so as to move the carrier element on the basis of electrostatic and/or electromagnetic and/or piezoelectric and/or thermal principles.

16. The antenna device in accordance with claim 1, wherein the antenna element is implemented as a Vivaldi antenna, or wherein the antenna element is implemented as an antenna patch, or wherein the antenna element is implemented as a dipole, or wherein the antenna element is implemented as a slot antenna, or wherein the antenna element is implemented as a Yagi antenna.

17. The antenna device in accordance with claim 1, wherein the antenna device comprises several antenna elements, and wherein the antenna elements are arranged only on the carrier element.

18. The antenna device in accordance with claim 1, wherein the antenna device comprises several antenna elements, wherein the antenna elements are arranged on different carrier elements, and wherein the carrier elements are each arranged in a holding element.

19. The antenna device in accordance with claim 1, wherein the antenna elements are arranged regularly and advantageously in a matrix structure.

20. The antenna device in accordance with claim 1, wherein the antenna device comprises a driving element, wherein the driving element is implemented so as to electrically drive the several antenna elements such that the beam direction depends on driving.

21. The antenna device in accordance with claim 1, wherein the antenna device comprises a conducting structure for electrically contacting the antenna element, and wherein the conducting structure is arranged at least partly on the carrier element.

22. The antenna device in accordance with claim 21, wherein the conducting structure is implemented as a coplanar line.

23. The antenna device in accordance with claim 1, wherein the antenna device comprises at least one beam-shaping structure.

24. The antenna device in accordance with claim 23, wherein the beam-shaping structure is implemented as a lens, or wherein the beam-shaping structure is implemented as a spherical lens, or wherein the beam-shaping structure is implemented as a cylindrical lens, or wherein the beam-shaping structure is implemented as a reflector, or wherein the beam-shaping structure is implemented as a parabolic mirror, or wherein the beam-shaping structure comprises an adjusting structure, a conical portion and a semi-cylinder.

25. An antenna device, wherein the antenna device comprises at least one antenna element, wherein the antenna element is implemented so as to emit electromagnetic radiation in a beam direction—advantageously at frequencies in the GHz range—and/or receive same from a beam direction, wherein the antenna element is arranged on a carrier element, wherein the carrier element is arranged relative to a holding element—and advantageously in a recess thereof, wherein the carrier element is moveable relative to the holding element, and wherein the carrier element is implemented as a MEMS micromirror scanner made from silicon and having a metal structure which acts as the antenna element.

* * * * *